US006182293B1

(12) United States Patent
Mustin

(10) Patent No.: US 6,182,293 B1
(45) Date of Patent: Feb. 6, 2001

(54) SPORTS GLOVE

(76) Inventor: Donmardel E. Mustin, 18429 N. 36th Dr., Glendale, AZ (US) 85308

( * ) Notice: Under 35 U.S.C. 154(b), the term of this patent shall be extended for 0 days.

(21) Appl. No.: 09/354,056

(22) Filed: Jul. 15, 1999

(51) Int. Cl.[7] ..... A41D 19/00
(52) U.S. Cl. ..... 2/161.1; 2/163; 2/168
(58) Field of Search ..... 2/16, 20, 158, 2/159, 161.1, 161.5, 161.7, 166, 167, 168, 169, 917; 473/59, 450, 615

(56) References Cited

U.S. PATENT DOCUMENTS

| | | | | |
|---|---|---|---|---|
| 1,885,572 | * | 11/1932 | Wood | 2/159 |
| 4,496,151 | * | 1/1985 | Tureaud | 273/54 |
| 4,894,866 | * | 1/1990 | Walker | 2/161 |
| 5,079,776 | * | 1/1992 | Crawford | 2/20 |
| 5,345,611 | * | 9/1994 | Smith, Jr. | 2/160 |
| 5,500,956 | | 3/1996 | Schulkin et al. . | |
| 5,727,257 | | 3/1998 | Chen . | |
| 5,782,516 | * | 7/1998 | Partida | 294/25 |
| 5,864,884 | | 2/1999 | Salvitti . | |
| 6,055,669 | * | 5/2000 | Albert | 2/161.1 |

FOREIGN PATENT DOCUMENTS

| | | | | |
|---|---|---|---|---|
| 1473744 | * | 5/1977 | (GB) | 2/161.3 |

* cited by examiner

*Primary Examiner*—John J. Calvert
*Assistant Examiner*—Katherine Moran
(74) *Attorney, Agent, or Firm*—Parsons & Goltry; Robert A. Parsons; Michael W. Goltry

(57) ABSTRACT

A sports glove including a body portion designed to fit in the palm, a thumb engaging portion, a plurality of different finger engaging portions, and a flexible wrist band are affixed to the body portion. A ball holding suction cup defining a semi-spherical depression positioned to open outwardly from the palm is affixed to a centrally located opening in the body portion. The body portion, thumb engaging portion, plurality of finger engaging portions, and the wrist band cooperate to position the ball holding suction cup firmly in the palm so as to operate as a ball holding suction cup with the hand slightly closed and to release suction in the suction cup with the hand extended.

16 Claims, 3 Drawing Sheets

SPORTS GLOVE

FIELD OF THE INVENTION

This invention relates to a sports glove.

More particularly, the present invention relates a sports glove for use in ball handling.

In a further and more specific aspect, the instant invention concerns a sports glove for use in sports such as basketball.

BACKGROUND OF THE INVENTION

In many of today's sports, such as basketball, speedball, football, etc., it is part of the game for the participants to use their hands while moving the ball. In basketball, for example, many of the larger, professional players have large enough hands to "palm" the ball, i.e. encircle a large enough portion of the ball to hold it like a baseball player holds a baseball. This puts players with smaller hands at a substantial disadvantage, since they must either use two hands to hold the ball or must place their hand under the ball and balance it on their hand. Since most of these games are played by all sizes and ages of people, the size of the hand is a substantial handicap.

It would be highly advantageous, therefore, to remedy the foregoing and other deficiencies inherent in the prior art.

Accordingly, it is an object of the present invention to provide a new and improved sports glove for handling balls in various sports.

Another object of the invention is to provide a new and improved sports glove which reduces the handicap for smaller players and for players with smaller hands.

And another object of the invention is to provide a new and improved sports glove which is inexpensive and easy to use.

SUMMARY OF THE INVENTION

Briefly, to achieve the desired objects of the instant invention in accordance with a preferred embodiment thereof, provided is a sports glove including a body portion designed to fit in the palm of a human hand, a thumb engaging portion and a plurality of different finger engaging portions affixed to the body portion. A resilient depressed area is positioned in the body portion to operate as a ball holding suction cup.

In a preferred embodiment, the sports glove includes a body portion designed to fit in the palm, a thumb engaging portion, a plurality of different finger engaging portions, and a flexible wrist band affixed to the body portion. A ball holding suction cup defining a semi-spherical depression positioned to open outwardly from the palm is affixed to a centrally located opening in the body portion. The body portion, thumb engaging portion, plurality of finger engaging portions, and the wrist band cooperate to position the ball holding suction cup firmly in the palm so as to operate as a ball holding suction cup with the hand slightly closed and to release suction in the suction cup with the hand extended.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
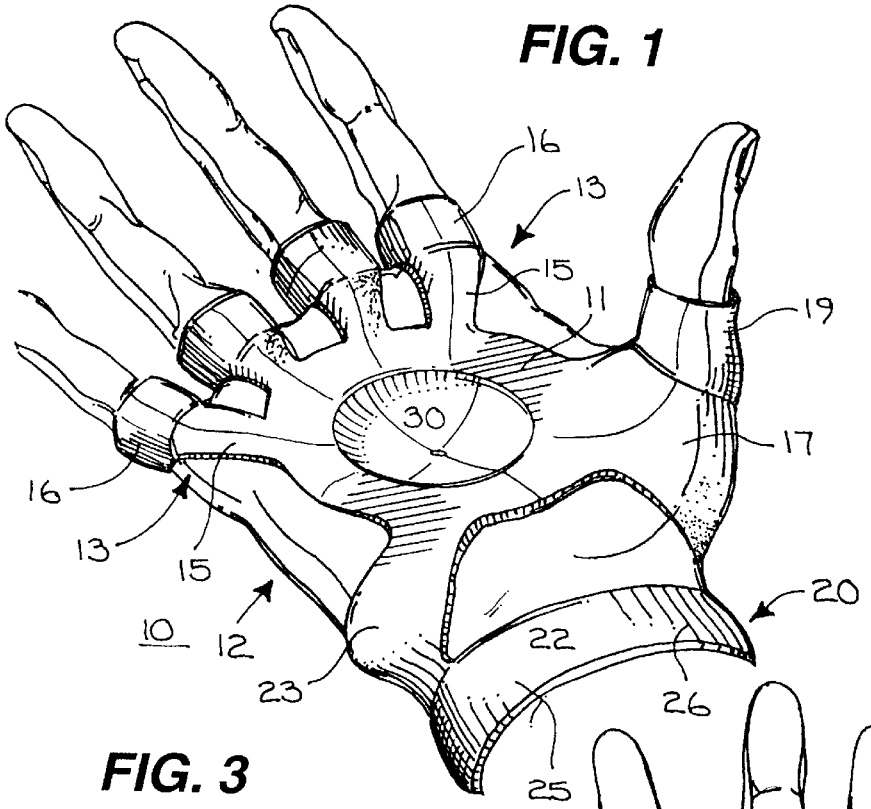
FIG. 1 is an isometric view of a sports glove in accordance with the present invention on a human hand.
Figure 2:
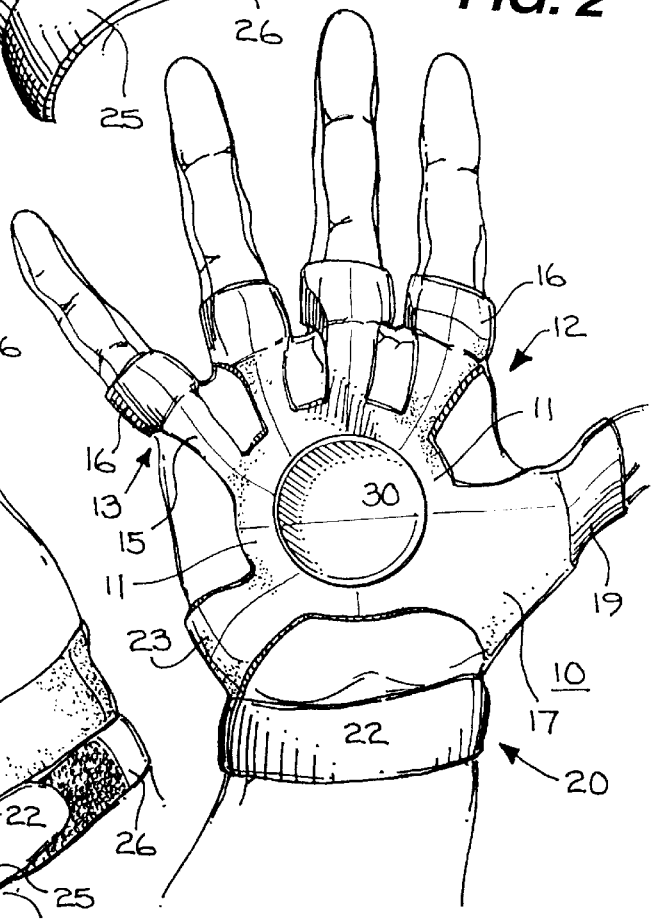
FIG. 2 is a view in top plan of the sports glove of FIG. 1.
Figure 3:
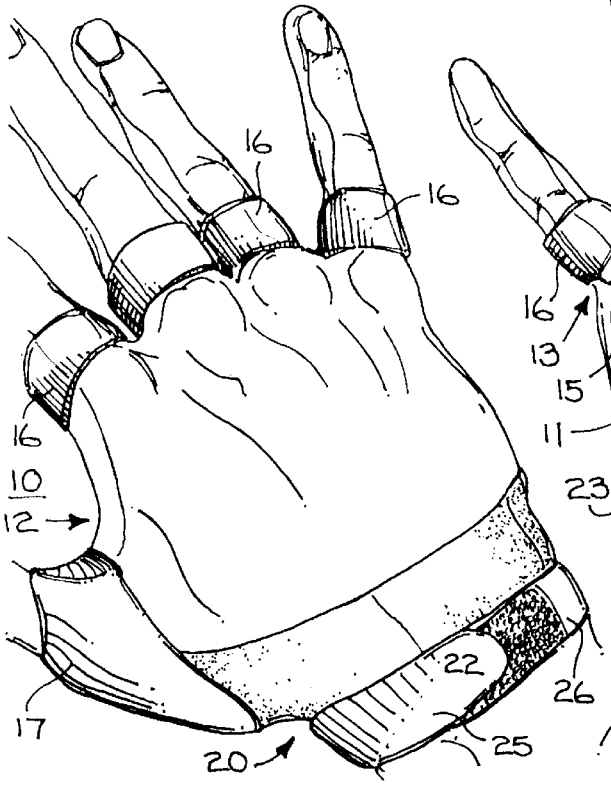
FIG. 3 is a rear view of the sports glove of FIG. 1.

Turning now to the drawings in which like reference characters indicate corresponding elements throughout the several views, attention is first directed to FIGS. 1, 2, and 3 which illustrate a sports glove 10 in accordance with the present invention. Sports glove 10 includes a body portion 11 designed to fit in the palm of a human hand, generally designated 12. Sports glove 10 also includes a plurality of finger engaging portions 13, each of which includes a finger tab 15 and a finger encircling ring 16. Each finger tab 15 has one end attached to body portion 11 and a finger encircling ring 16 attached to an outer end thereof. In this embodiment, finger tabs 15 are made of an elastic material (e.g. rubber, plastic, elastic cloth, etc.) designed to stretch slightly to allow sports glove 10 to fit many different sizes of hands and to place a slight bias on body portion 11 to hold it firmly in place. Also, finger rings 16 may be made of elastic material, if desired, to allow them to fit many different sized fingers. In some applications, it may be desirable to simply form finger tabs 15 and/or finger rings 16 of a flexible material which is formed to fit with only a small amount of stretching. Here it should be understood that in this preferred embodiment, each of the four fingers of hand 12 have a tab and ring attached to provide the optimum operation, but the glove could include less finger tabs and rings if for some reason this were desired.

Sports glove 10 also includes a thumb engaging portion 17, which is formed of a thumb tab 18, having one end attached to body portion 11 and extending outwardly therefrom, and a thumb encircling ring 19 attached to an outer end of thumb tab 18. In this embodiment, thumb tab 18 is made of an elastic material (e.g. rubber, plastic, elastic cloth, etc.) designed to stretch slightly to allow sports glove 10 to fit many different sizes of hands and to place a slight bias on body portion 11 to hold it firmly in place. Also, thumb ring 19 may be made of elastic material, if desired, to allow it to fit many different sized thumbs. In some applications, it may be desirable to simply form thumb tab 18 and/or thumb ring 19 of a flexible material which is formed to fit with only a small amount of stretching.

Figure 4:
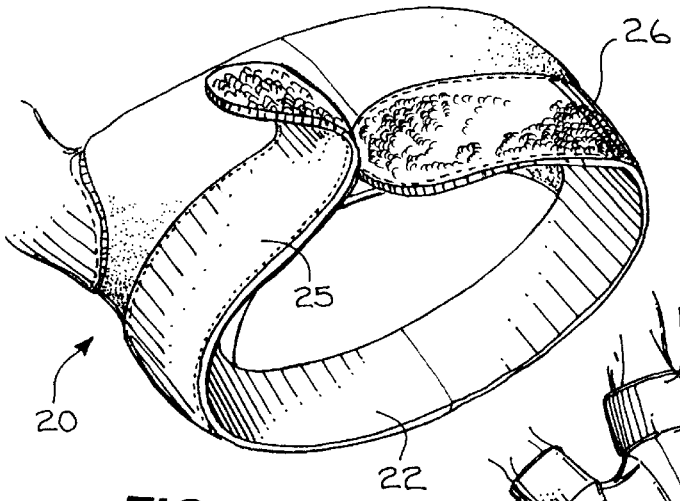
FIG. 4 is an enlarged view of a wrist engaging portion of the sports glove of FIG. 1.
Figure 5:
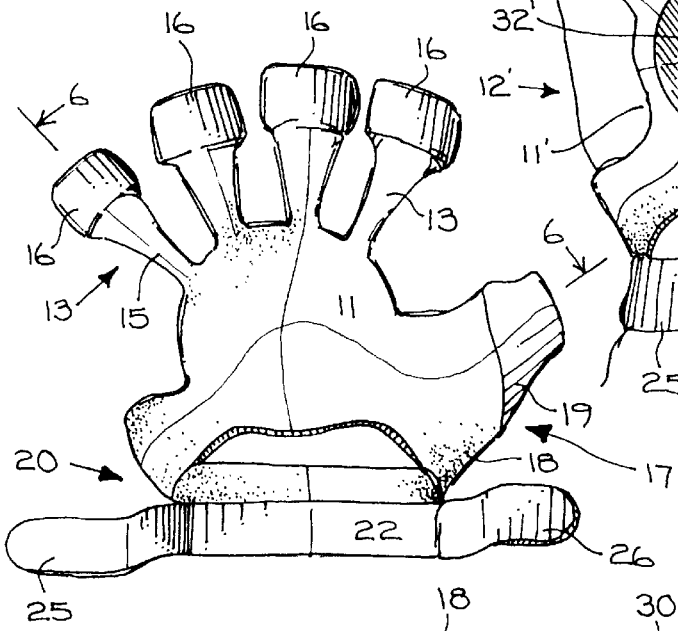
FIG. 5 is a view of the inside of the sports glove of FIG. 1, without being placed on a human hand.

Thumb tab 18 is broadened slightly to also have attached thereto a wrist engaging portion, generally designated 20. Wrist engaging portion 20 includes a wrist band 22 and a wrist tab 23. One end of wrist tab 23 is attached to body portion 11 and flexible wrist band 22 is attached to the other end. Also wrist band 22 is attached to the broadened portion of thumb tab 18 at the other side of hand 12. In this embodiment, wrist tab 23 is made of an elastic material (e.g. rubber, plastic, elastic cloth, etc.) designed to stretch slightly to allow sports glove 10 to fit many different sizes of hands and to place a slight bias on body portion 11 to hold it firmly in place. In some applications, it may be desirable to simply form wrist tab 23 of a flexible material which is formed to fit with only a small amount of stretching. In this preferred embodiment, flexible wrist band 22 includes a pair of wrist tabs 25 and 26, best seen in FIGS. 4 and 5, each formed to partially encircle the wrist of hand 12 in opposite directions and further including strips of matching VELCRO material for attaching wrist tabs 25 and 26 together. It will of course be understood that standard snaps, buckles, or the like can be used in place of the VELCRO if desired.

Figure 6:
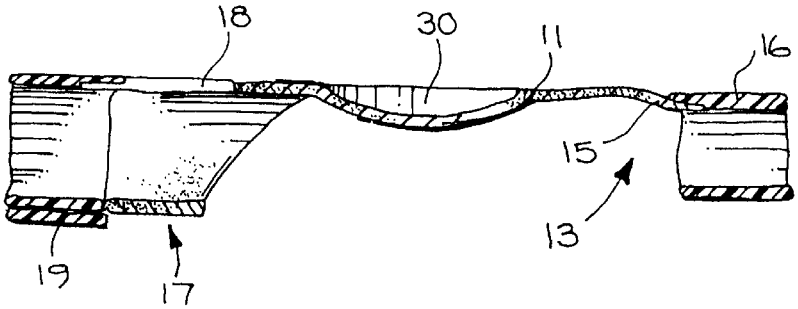
FIG. 6 is a sectional view of the sports glove as seen from the line 6—6 in FIG. 5.

Sports glove 10 further includes a resilient depressed area 30 positioned in body portion 11 to operate as a ball holding suction cup, as can be seen best with additional reference to FIG. 6. Area 30, hereinafter referred to as suction cup 30, includes a piece of resilient material defining a semi-spherical depression positioned to open outwardly from the palm of hand 12. Generally, the semi-spherical depression is formed similar to a suction cup so as to flatten slightly when pressed against a surface, thereby forcing air out of the depression. The sides of the depression are then held firmly against the surface by the partial vacuum formed in the depression when the air is forced out. In this preferred embodiment, body 11 is formed of a resilient material, such as rubber, plastic, or the like, with ball holding suction cup 30 integrally formed to define a centrally located opening in body portion 11. In some applications it may be desirable to form resilient suction cup 30 separately and to affix it in a centrally located opening in body portion 11.

Figure 7:
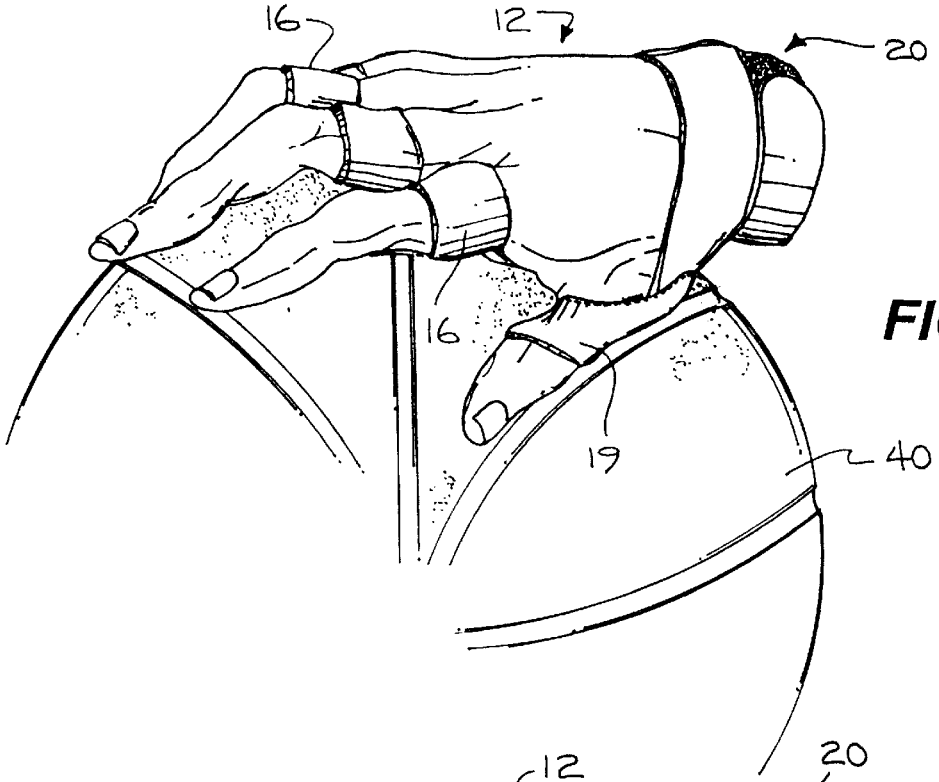
FIG. 7 is an isometric view of the sports glove of FIG. 1 in a ball-gripping position.
Figure 8:
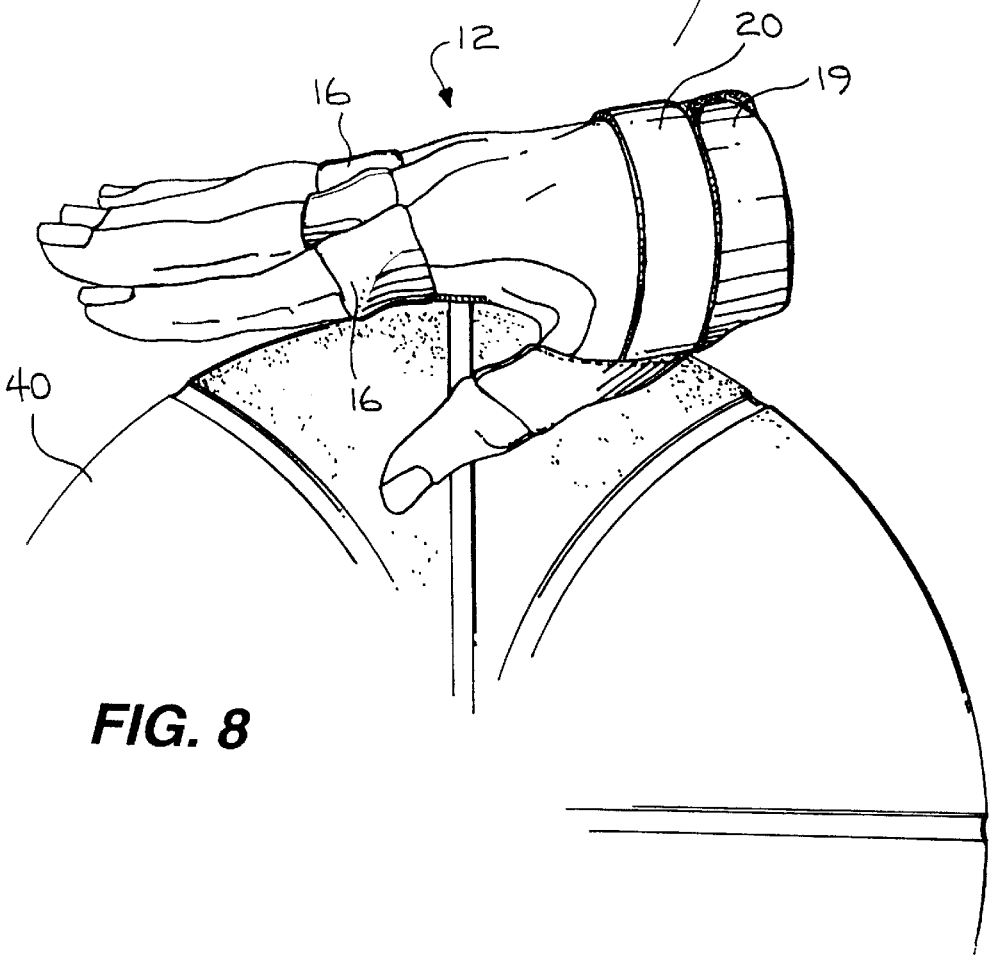
FIG. 8 is an isometric view of the sports glove of FIG. 1 in a ball-releasing position.

Turning now to FIG. 7. an isometric view of sports glove 10 on hand 12 in a ball holding position on a basketball 40 is illustrated. In this view, the fingers and thumb of hand 12 are placed in a ball encircling, or slightly closed, position but, as is illustrated, hand 12 is too small to effectively grip basketball 40. However, suction cup 30 of sports glove 10 has engaged the surface of basketball 40 and firmly holds basketball 40 in hand 12. Referring to FIG. 8, it can be seen that basketball 40 can be quickly and easily disengaged from hand 12 by simply opening or extending hand 12. By opening or extending hand 12 the fingers and thumb stretch body portion 11 sufficiently to break the seal of suction cup 30 on the surface of basketball 40 and release basketball 40. Thus, any person, regardless of the size of the hand, can effectively hold a sports ball and are substantially less handicapped at playing the sport.

Figure 9:
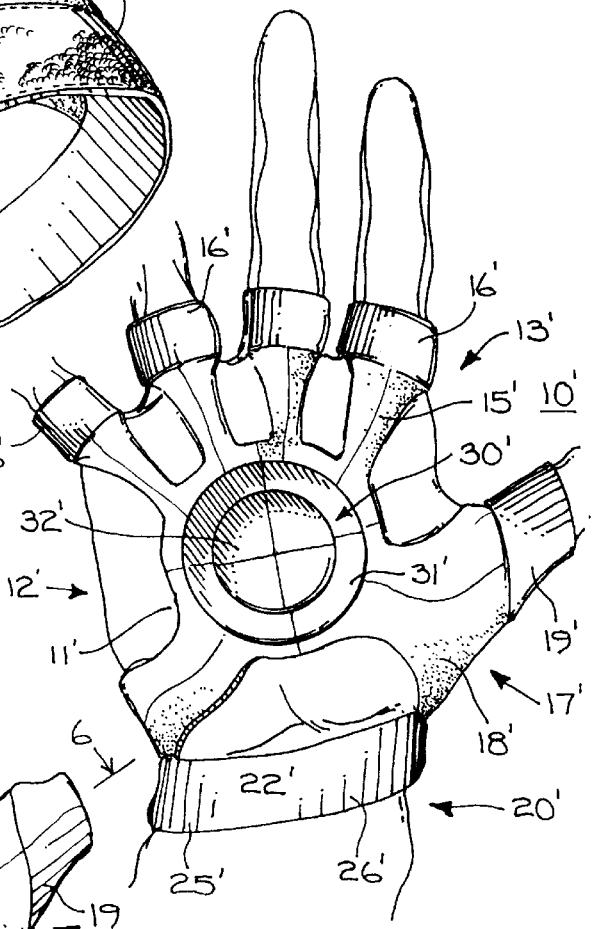
FIG. 9 is a view in front elevation of another embodiment of a sports glove in accordance with the present invention.

Turning now to FIG. 9, a sports glove 10' is illustrated wherein parts similar to those of FIG. 1 are designated with similar numbers and a prime is added to indicate the different embodiment. In this embodiment, body portion 11' includes a flexible area 30' which is designed to define a first suction cup 31' having a second suction cup 32' disposed generally coaxially in the center thereof. One purpose of the plurality of coaxial suction cups is to increase the suction and, thus, the ball holding capabilities. In some specific applications, for example where a person has a large hand but relatively short fingers, it may be desirable to provide a plurality of ball holding suction cups laterally disposed from each other to grip or hold the ball in a plurality of spaced apart locations.

Thus, a new and improved sports glove for handling balls in various sports has been disclosed. The new and improved sports glove substantially reduces the handicap for smaller players and for players with smaller hands so that virtually any person, regardless of the size of the hand, can effectively hold a sports ball and is substantially less handicapped at playing the sport. Also, the new and improved sports glove is relatively inexpensive and easy to use.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A sports glove comprising:

a body portion designed to fit in a palm of a human hand;

a thumb engaging portion including a thumb tab extending outwardly from the body portion and a thumb encircling ring attached to an outer end of the thumb tab, and a plurality of different finger engaging portions affixed to the body portion; and a resilient depressed area positioned in the body portion to operate as a ball holding suction cup, the resilient depressed area includes a piece of resilient material defining a semi-spherical depression, the resilient material including one of rubber or plastic, with the piece being affixed to a centrally located opening in the body portion.

2. A sports glove as claimed in claim 1 wherein the body portion is formed of a flexible, soft material including one of leather, cloth, and plastic.

3. A sports glove as claimed in claim 1 wherein the body portion substantially covers the palm.

4. A sports glove as claimed in claim wherein the thumb tab is formed of an elastic material.

5. A sports glove as claimed in claim 4 wherein the thumb encircling ring is formed of an elastic material.

6. A sports glove as claimed in claim 1 wherein the resilient depressed area is formed to operate as a plurality of ball holding suction cups.

7. A sports glove as claimed in claim 1 including in addition a flexible wrist band attached to the body portion.

8. A sports glove as claimed in claim 7 wherein the flexible wrist band includes a pair of wrist tabs each formed to partially encircle a wrist in opposite directions and further including hook and loop fastener strips for attaching the wrist tabs together.

9. A sports glove comprising:

a body portion designed to fit in a palm of a human hand;

a thumb engaging portion and a plurality of different finger engaging portions affixed to the body portion, each of the plurality of different finger engaging portions includes a finger tab extending outwardly from the body portion and a finger encircling ring attached to an outer end of the finger tab; and a resilient depressed area positioned in the body portion to operate as a ball holding suction cup.

10. A sports glove as claimed in claim 9 wherein each of the finger tabs is formed of an elastic material.

11. A sports glove as claimed in claim 9 wherein each of the finger encircling rings is formed of an elastic material.

12. A sports glove comprising:

a body portion designed to fit in a palm of a human hand, the body portion is formed of a flexible, soft material including one of leather, cloth, and plastic;

a thumb engaging portion including an elastic thumb tab extending outwardly from the body portion and a thumb encircling ring attached to an outer end of the thumb tab, and a plurality of different finger engaging portions affixed to the body portion, each of the plurality of different finger engaging portions includes an elastic finger tab extending outwardly from the body portion and a finger encircling ring attached to an outer end of the finger tab; and a ball holding suction cup affixed to the body portion and positioned to define a centrally located opening in the body portion, the ball holding suction cup including a piece of resilient material defining a semi-spherical depression positioned to open outwardly from the palm.

13. A sports glove as claimed in claim 12 wherein the piece of resilient material defining a semi-spherical depression is formed to define a plurality of semi-spherical depressions designed to operate as a plurality of ball holding suction cups.

14. A sports glove as claimed in claim 12 including in addition a flexible wrist band attached to the body portion.

15. A sports glove as claimed in claim 14 wherein the flexible wrist band includes a pair of wrist tabs each formed to partially encircle a wrist in opposite directions and further including hook and loop fastener for attaching the wrist tabs together.

16. A sports glove comprising:

a body portion designed to fit in a palm of a human hand, and formed of a flexible, soft material including one of leather, cloth, and plastic;

a thumb engaging portion including an elastic thumb tab extending outwardly from the body portion and a thumb encircling ring attached to an outer end of the thumb tab, and a plurality of different finger engaging portions affixed to the body portion, each of the plurality of different finger engaging portions includes an elastic finger tab extending outwardly from the body portion and a finger encircling ring attached to an outer end of the finger tab;

a ball holding suction cup affixed to the body portion and positioned to define a centrally located opening in the body portion, the ball holding suction cup including a piece of resilient material defining a semi-spherical depression positioned to open outwardly from the palm;

a flexible wrist band attached to the body portion; and the body portion, thumb engaging portion, plurality of finger engaging portions and the wrist band cooperating to position the ball holding suction cup firmly in the palm so as to operate as a ball holding suction cup with the hand slightly closed and to release suction in the suction cup with the hand extended.

* * * * *

UNITED STATES PATENT AND TRADEMARK OFFICE

CERTIFICATE OF CORRECTION

PATENT NO. : 6,182,293 B1
DATED : February 6, 2001
INVENTOR(S) : Donmardel E. Mustin It is certified that error appears in the above-identified patent and that said Letters Patent is hereby corrected as shown below:

Column 4,
Line 30, insert -- 1 -- between “claim” and “wherein.”
Line 32, replace “4” with -- 1 --.

Signed and Sealed this

Fifteenth Day of October, 2002

*Attest:*

*Attesting Officer*

JAMES E. ROGAN
*Director of the United States Patent and Trademark Office*